US008858181B2

(12) United States Patent
Cloarec

(10) Patent No.: US 8,858,181 B2
(45) Date of Patent: Oct. 14, 2014

(54) CIRCUMFERENTIAL BLOCKING DEVICE OF CLAMP VANES FOR TURBINE ENGINE, WITH IMPROVED RADIAL DEPLOYMENT

(75) Inventor: Yvon Cloarec, Ecuelles (FR)

(73) Assignee: SNECMA, Paris (FR)

( * ) Notice: Subject to any disclaimer, the term of this patent is extended or adjusted under 35 U.S.C. 154(b) by 549 days.

(21) Appl. No.: 13/224,774

(22) Filed: Sep. 2, 2011

(65) Prior Publication Data

US 2012/0063907 A1 Mar. 15, 2012

(30) Foreign Application Priority Data

Sep. 13, 2010 (FR) ..... 10 57266

(51) Int. Cl.
*F01D 5/30* (2006.01)
*F01D 5/32* (2006.01)

(52) U.S. Cl.
CPC ..... *F01D 5/3038* (2013.01); *F01D 5/32* (2013.01); *F05D 2230/64* (2013.01)
USPC .... 416/204 R; 416/206; 416/215; 416/219 R; 416/220 R; 416/221

(58) Field of Classification Search
USPC ..... 416/204 R, 206, 215, 219 R, 220 R, 221, 416/204 A
See application file for complete search history.

(56) References Cited

U.S. PATENT DOCUMENTS

| | | | | |
|---|---|---|---|---|
| 3,986,779 | A | 10/1976 | Beckershoff | |
| 5,443,366 | A * | 8/1995 | Knott et al. | 416/221 |
| 2003/0123986 | A1 | 7/2003 | Antunes et al. | |
| 2007/0014667 | A1 | 1/2007 | Pickens et al. | |

FOREIGN PATENT DOCUMENTS

| | | |
|---|---|---|
| EP | 1 314 856 A1 | 5/2003 |
| EP | 1 744 013 A2 | 1/2007 |
| EP | 1 744 013 A3 | 1/2007 |

OTHER PUBLICATIONS

French Preliminary Search Report and Written Opinion of the Searching Authority issued Apr. 15, 2011, in Patent Application No. FR 1057266, (with English Translation of Category of Cited Documents).

* cited by examiner

*Primary Examiner* — Igor Kershteyn
(74) *Attorney, Agent, or Firm* — Oblon, Spivak, McClelland, Maier & Neustadt, L.L.P.

(57) ABSTRACT

The invention relates to a device (30) for blockage of vanes in a circumferential groove (10) of a turbine engine disc, the device being intended to deploy in a radial direction to be locked in the circumferential groove open radially. According to the invention, the blocking device comprises a first and a second piece (32, 34) designed to deploy in the radial direction by relative displacement of these pieces in the circumferential direction (23).

11 Claims, 16 Drawing Sheets

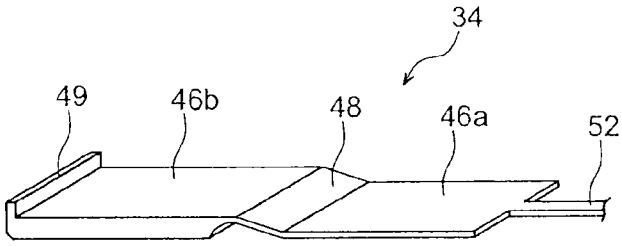
FIG. 6
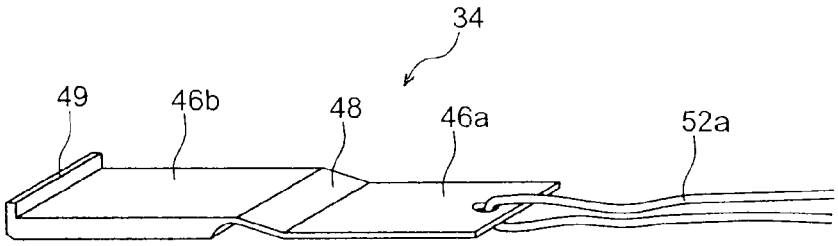
FIG. 7
FIG. 8a
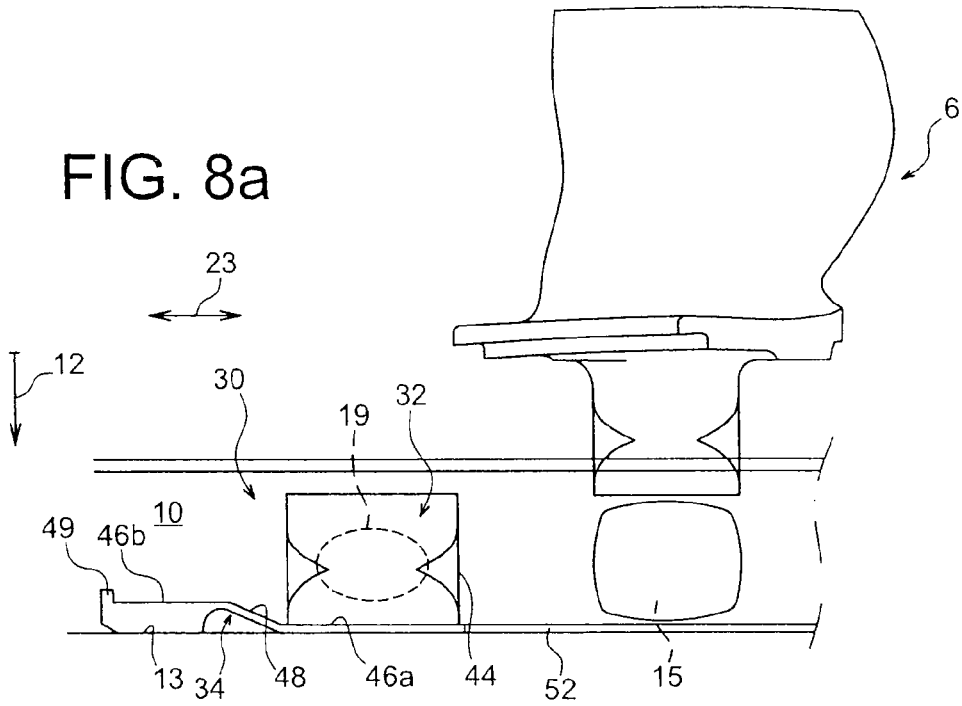

CIRCUMFERENTIAL BLOCKING DEVICE OF CLAMP VANES FOR TURBINE ENGINE, WITH IMPROVED RADIAL DEPLOYMENT

TECHNICAL FIELD

The present invention relates to a wheel of a turbine engine, comprising a disc and a plurality of hammer clamp vanes mounted on this same disc, in a circumferential groove of the latter. The wheel is preferably intended to form an axial compressor or turbine stage, for the high- or low-pressure body.

The invention also relates to a circumferential blocking device of vanes in the groove of the disc open radially.

The invention applies in particular to a wheel of a turbine engine for aircraft, for example of the type for turbojet or turboprop. It applies more generally to any hammer clamp wheel, for example for a steam turbine.

PRIOR ART

Circumferential blocking devices of hammer clamp vanes in the groove of a turbine engine aircraft disc are known for example from documents EP 1 621 732, EP 0 305 223, or EP 1 164 251. They are designed such of that they lock in a determined position of the groove of the disc, where they can be blocked according to the circumferential direction, and therefore constitute stops in this same direction for the vanes. Because of this, the circumferentially blocked vanes cannot escape from the circumferential groove into which they were previously introduced, via an introduction window of their base.

The locking of a blocking device is usually done by deploying it in the groove, according to the radial direction. A first type of deployment is done using elastic means, as is the case in the two first documents cited hereinabove. However, these elastic means prove poorly adapted to a high-temperature environment.

A second type of deployment is done by screwing, as is known from the latter document cited hereinabove. However, the screw system employed is often subject to jamming, requiring partial or total destruction of the blocking device during dismantling of the vanes, with the risk of damage to the disc. Also, the presence of the screw system requires access at the level of the vane platforms for screwing, which disturbs the flow of the vein.

SUMMARY OF THE INVENTION

The aim of the invention therefore is to rectify at least partially the disadvantages mentioned hereinabove, relative to the embodiments of the prior art.

For this, the initial object of the invention is a vane blocking device in a circumferential groove of a turbine engine disc, said device being intended to be deployed in a radial direction to be locked in said circumferential groove open radially. According to the invention, said blocking device comprises a first and second piece designed to be deployed in the radial direction by relative displacement of said pieces in the circumferential direction.

Thus, the invention is remarkable by its system of deployment, the design of which limits the number of pieces required, does not necessarily require access at the level of the vane platforms, limits the risks of jamming, and also supports a high-temperature ambience.

Also, it is particularly easy to handle. By way of indication, the relative displacement of the two pieces of the device, in the circumferential direction, can be controlled from the introduction window of the vane bases.

Preferably, at least one of said first and second pieces is equipped with a gripping member allowing it to be taken along relative to the other piece, according to the circumferential direction. This gripping member can be a tab or a cable for example.

Preferably, the piece equipped with the gripping member has a stop in the circumferential direction, provided to ensure proper relative positioning of the two pieces of the blocking device occupying the configuration deployed.

Preferably, at least one of said first and second pieces has a ramp for deployment of the device in the radial direction, during relative displacement of said pieces in the circumferential direction.

Preferably, the blocking device is equipped with locking means of the two pieces in radially deployed position. The resulting locking therefore ensures blockage in translation of the two pieces relative to each other, according to the circumferential direction.

The invention also relates to a system comprising two pieces intended to enter respectively in the constitution of two blocking devices such as that described hereinabove, said two pieces being joined together by said gripping member on either side of which they are located. Thus, actioning the same gripping member advantageously produces simultaneous locking of two blocking devices.

Another aim of the invention is a wheel of a turbine engine comprising a disc with circumferential groove, vanes whereof the bases are retained radially by said groove, as well as at least one circumferential blocking device of vanes such as described hereinabove. The wheel is preferably provided to enter the constitution of a compressor stage, high- or low-pressure, but could alternatively be provided to form a turbine stage of the turbine engine.

Another aim of the invention is a turbine engine, preferably for aircraft, for example of the turbojet or turboprop type, comprising at least one wheel such as mentioned hereinabove.

It can alternatively be any other type of turbine engine, such as a steam or gas turbine.

Finally, the aim of the invention is a process for installing a blocking device such as described previously, in the circumferential groove of a turbine engine disc, comprising the following steps:

- placing of said blocking device in the circumferential groove; and
- deployment of said blocking device in the radial direction to lock it in said circumferential groove, by relative displacement of said first and second pieces in the circumferential direction.

Other advantages and characteristics of the invention will emerge from the following detailed and non-limiting description.

BRIEF DESCRIPTION OF THE DRAWINGS

This description will be given in reference to the attached diagrams, in which;

FIG. 6 illustrates one of the pieces of the blocking device, according to another preferred embodiment;

FIG. 7 illustrates one of the pieces of the blocking device, according to yet another preferred embodiment;

FIGS. 8*a* to 8*c* outline a process according to a preferred embodiment of the invention, for installing the blocking device integrating the piece shown in FIG. 6;

DETAILED DESCRIPTION OF PREFERRED EMBODIMENTS

Figure 1:
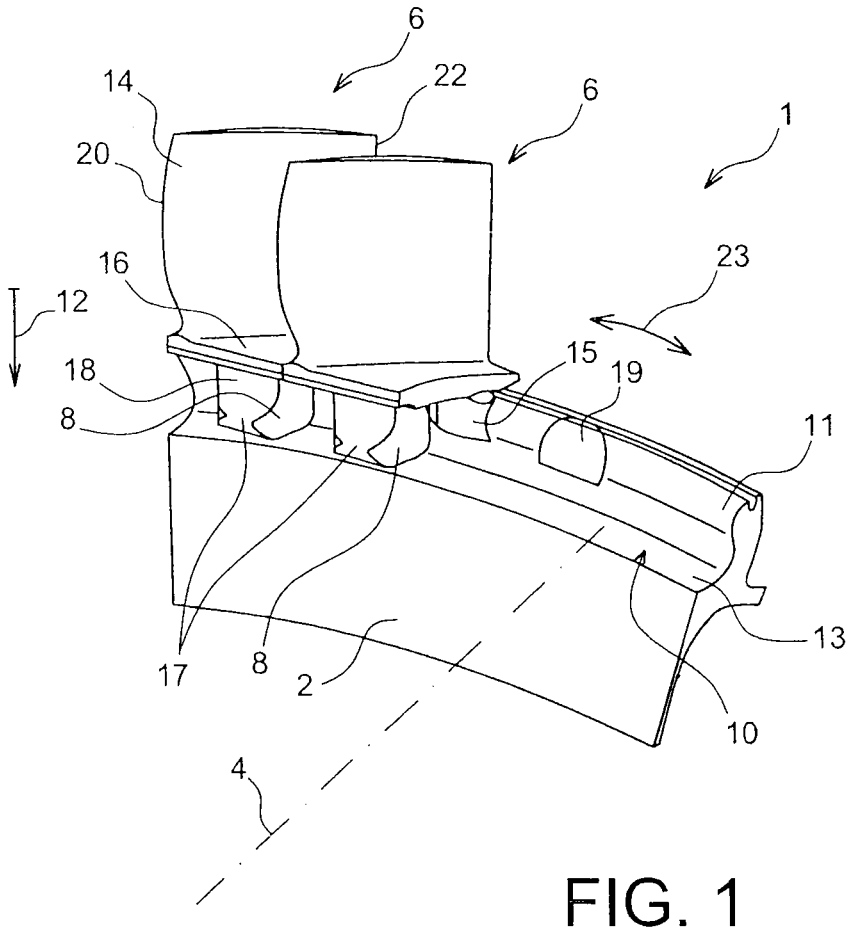
FIG. 1 illustrates a perspective view of part of a wheel of compressor stage of a turbojet, according to a preferred embodiment of the invention.
Figure 2:
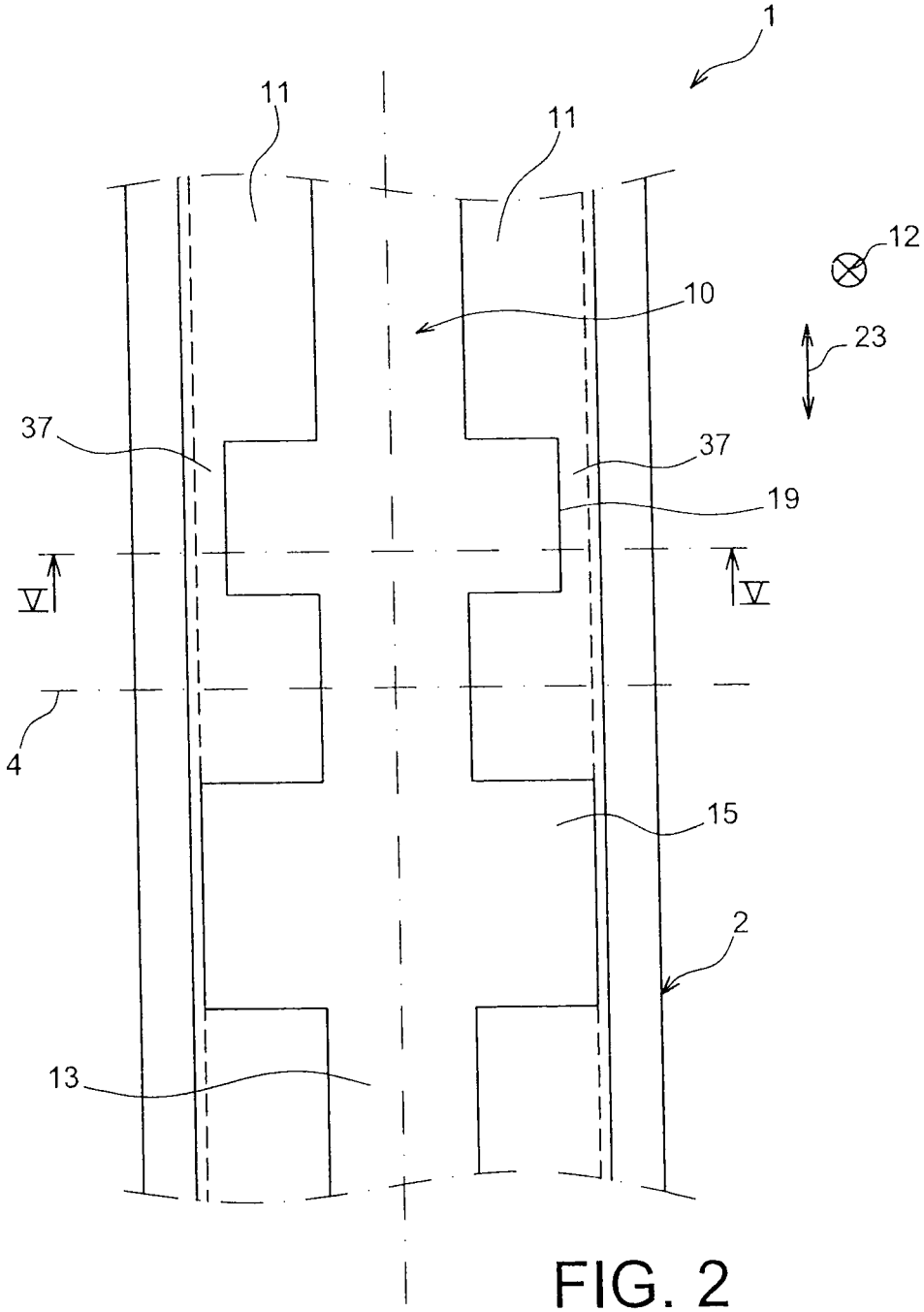
FIG. 2 shows a partial plan view of the disc of the wheel of FIG. 1.

In reference first to FIGS. 1 and 2, these show a wheel part 1 of a high-pressure compressor of an aircraft turbine engine such as a turbojet, this wheel 1 preferably intended to constitute part of one of the rear stages of this high-pressure compressor, in the form of a preferred embodiment of the present invention.

The wheel 1 first comprises a disc 2 having a central axis 4 corresponding to the longitudinal axis of the turbojet. At the level of a circumferential radial end of this disc 2 the latter bears a plurality of so-called hammer clamp vanes 6, which are therefore distributed angularly right around the central axis 4. These hammer clamp vanes 6 specifically comprise a vane base 8 intended to be housed in a circumferential groove 10 of the disc 2, this circumferential groove of the disc located therefore at the level of a radial end of the disc 2 and being open radially to the exterior. As is disclosed by the expert, this circumferential groove 10 has a transversal cross-section in the form of dovetail, delimited especially by a base 13 and by two annular lateral rims 11, of enlarged thickness and placed opposite each other. In other terms, the circumferential groove 10 overall has the form of a C opening radially to the exterior, and letting the standard of the vane, as will be described now, pass between the two ends of this C defined by the rims 11.

In fact, as known to the expert each vane 6 successively comprises in a radial direction to the interior, represented by arrow 12, a blade 14, a platform 16, a standard 18 and finally the abovementioned vane base 8. It is noted here that the blade conventionally a leading edge 20 and a trailing edge 22, the trailing edge 22 being offset towards the circumferential direction 23 of the disc relative to the leading edge 20 according to a given offset, a function of the profile of this blade. Next, the platform has a circumferential length much longer than that of the blade 14 it supports, and is preferably intended to come close to the platform of the two vanes 6 of the assembly directly adjacent. Thus, when the assembly of vanes is mounted inside the groove 10, the platforms 16 of these vanes form substantially a crown centred on the axis 4, covering the annular rims 11.

Also, it is noted that the radial holding to the exterior of each vane 6 relative to the disc 2 is ensured conventionally by the contact of two footprints 17 made on the base 8 and oriented substantially radially to the exterior, respectively with the two enlarged rims 11 of the circumferential groove 10.

The groove 10 has an introduction window for vane bases 15, via which a vane base can be introduced into this groove, by radial displacement of the relevant vane. For this, the window 15 is made from two axial notches made respectively in the two rims 11, the distance between the two notch bases opposite corresponding substantially to the axial length of a vane base 8.

Figure 3:
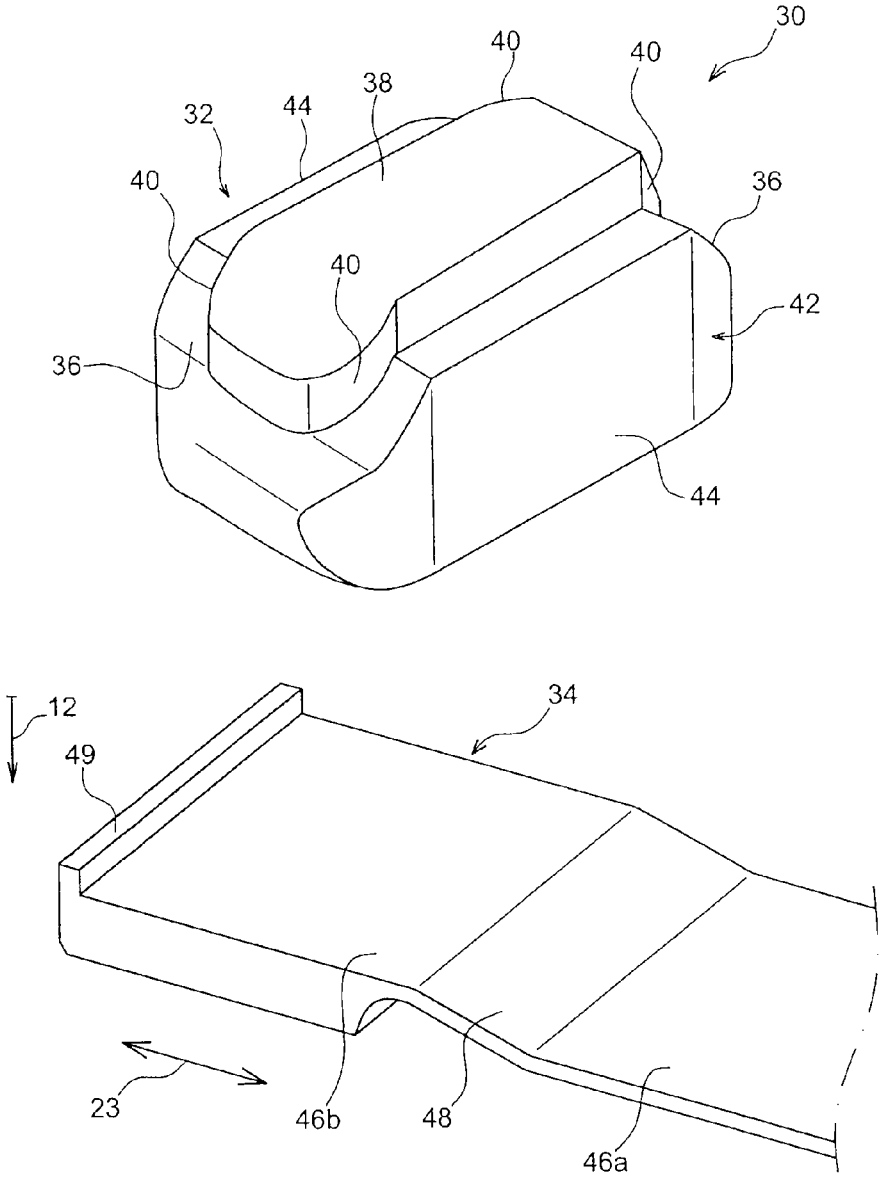
FIG. 3 illustrates an exploded view in perspective of a circumferential blocking device of vanes, designed to equip the wheel shown in FIG. 1, this device in the form of a preferred embodiment of the present invention.

Once inserted in the groove 10 by the window 15, each vane is then shifted circumferentially within the groove 10. Also, the vanes are kept in a circumferential position in the groove by means of one or more blocking devices (not shown in FIGS. 1 and 2), which are also subject matter of the present invention, and a preferred embodiment of which will now be described in reference to FIG. 3.

This figure illustrates a blocking device 30 comprising two distinct parts, a first part 32 called radially external, and a second part 34 called radially internal, taking the form of a wedge.

The first part 32 overall takes the form of a vane base, in particular with two footprints 36 arranged at the axial ends, and oriented substantially radially to the exterior. As will be specified in greater detail hereinbelow, these two surfaces 36 are intended to contact respectively the two enlarged rims 11 of the circumferential groove 10. A circumferential stop 38 extends radially to the exterior from these two surfaces 36. As known, this stop 38 is intended to be introduced to an opening of the groove 10, referenced as 19 in FIGS. 1 and 2. This opening 19 is similar to the introduction window 15, but has reduced axial length at the same time allowing the stop 38 to be introduced therein when the piece 32 is shifted radially to the exterior, and to the surfaces of radial stop 36 to be retained by the remaining edges of the groove 10. Holding the stop 38 in the opening 19, because of several contact surfaces 40 made on the stop 38, permits circumferential blockage of the first piece 32 in the groove 10. In this way, the body 42 of this first piece can in turn act as circumferential blockage for the vane bases, because of its two opposite surfaces of circumferential stop 44.

The second part 34 overall comprises two support surfaces of the first part 32, the second surface 46*b* being elevated radially relative to the first surface 46*a*, and being attached to the latter by a ramp 48. This second piece 34, which therefore extends circumferentially between the two support surfaces 46*a*, 46*b*, has a stop 49 in the circumferential direction, this stop 49 located at the end of the second support surface 46*b*, by being oriented radially to the exterior.

Figure 4A:
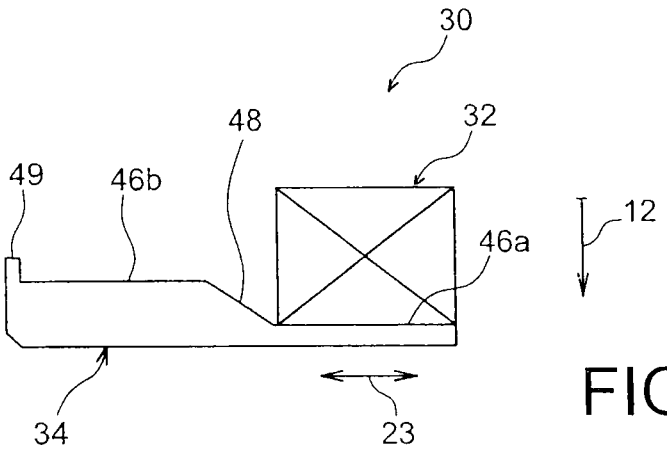
FIGS. 4*a* and 4*b* show sectional views outlining the operation of the blocking device shown in the preceding figure, FIGS. 5*a* and 5*b* respectively show the blocking device in retracted configuration and in deployed configuration, in the circumferential groove of the wheel disc, these views being taken along the line V-V of FIG. 2.
Figure 4B:
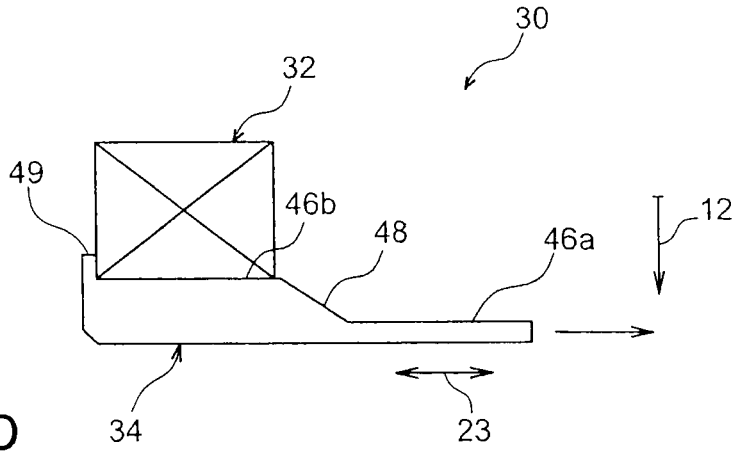

Consequently, the blocking device 30 is designed to pass from a retracted state such as shown in FIG. 4*a*, to a deployed state such as shown in FIG. 4*b*, by simple relative circumferential displacement between the pieces 32 and 34. In fact, in the retracted state, the first piece 32 is supported by the first surface 46*a* lowered radially. The radial extent of the device 30 is now reduced. By shifting the second part 34 according to the circumferential direction 23, relative to the first part 32 remaining fixed in this same direction, this first part slides on the ramp 48, then reaches the second surface 46*b* on which it is elevated radially. The device 30 adopts a deployed configuration in which its radial dimension is increased, which lets it unlock in the groove 10, as will now be described in reference to FIGS. 5*a* and 5*b*.

Figure 5A:
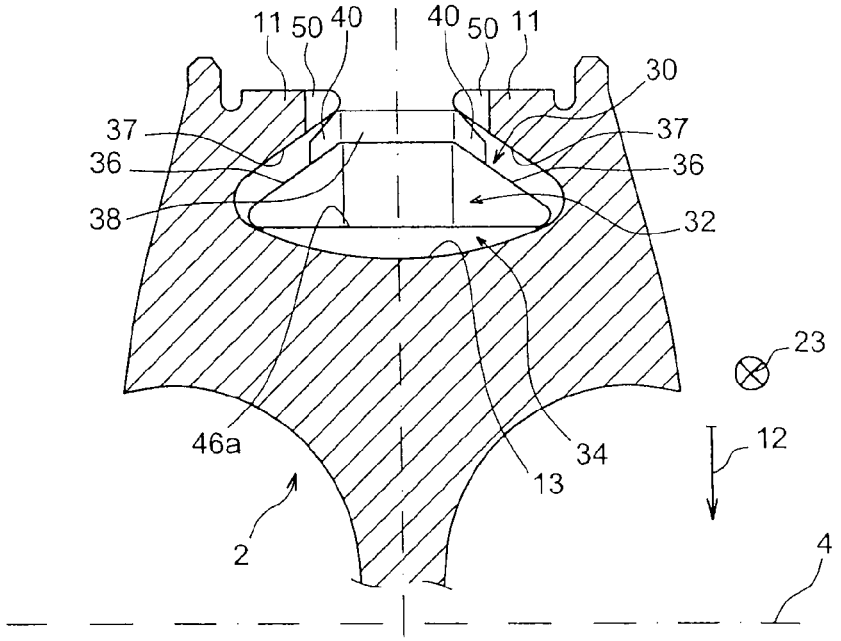
Figure 5B:
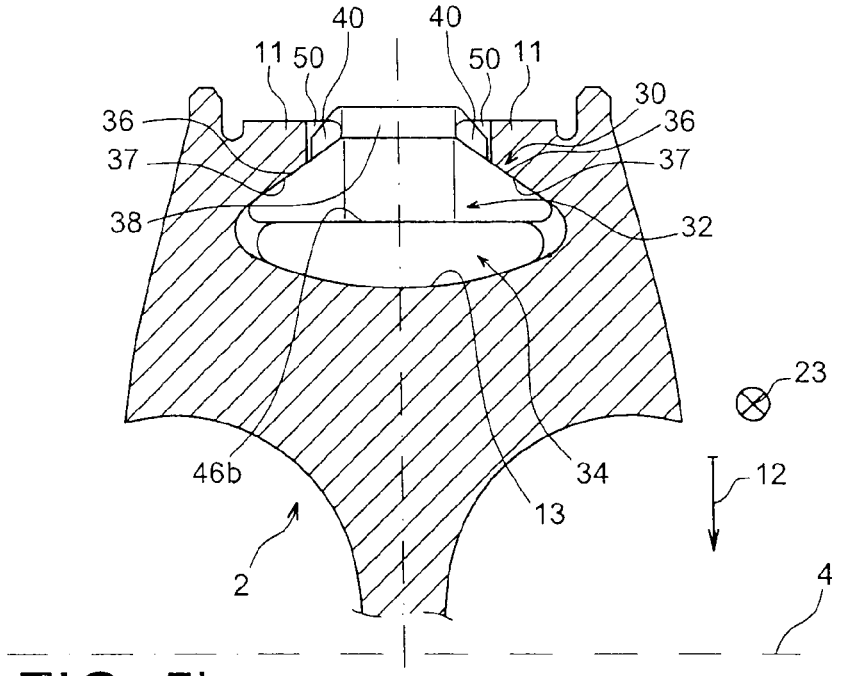

In fact, FIG. 5*a* shows the blocking device 30 in retracted configuration, in which the first piece 32 is supported by the first surface 46*a*. The first piece is located close to the base 13 of the groove 10, and its stop 38 is too retracted radially to the interior to cooperate with the opening 19. However, after circumferential displacement of the second piece 34, the blocking device 30 attains its deployed configuration shown in FIG. 5*b*, in which the first piece 32 is supported by the second surface 46*b*. In this state which has brought the first piece 32 to elevate radially, the stop 38 is introduced in the opening 19, resulting in contact of the surfaces 40 with the flanks 50 of the opening 19, and therefore circumferential retention of the first piece 32 in the groove 10, in both directions. This circumferential retention is accentuated by the radial support of the footprints 36 against inner surfaces 37 of the rims 11, which creates radial tightening of the blocking device 30 in the groove 10.

By way of indication, it is noted that relative circumferential displacement of the two pieces can be done in any way deemed appropriate by the expert, for example by using adapted tools. FIG. 6 shows an embodiment in which this displacement is employed.

Effectively, FIG. 6 shows that the second piece 34 of the blocking device 30 can be equipped with a gripping member making it easier to bring it along relative to the first piece, according to the circumferential direction. Here, the member takes the form of a tab 52 extending circumferentially from the first support surface 46*a*, in the direction opposite to that of the stop 49. As an alternative, the gripping member can be a cable 52*a*, as shown in FIG. 7.

It is noted that the gripping member can be designed to act by thrust and/or by traction.

Figure 8B:
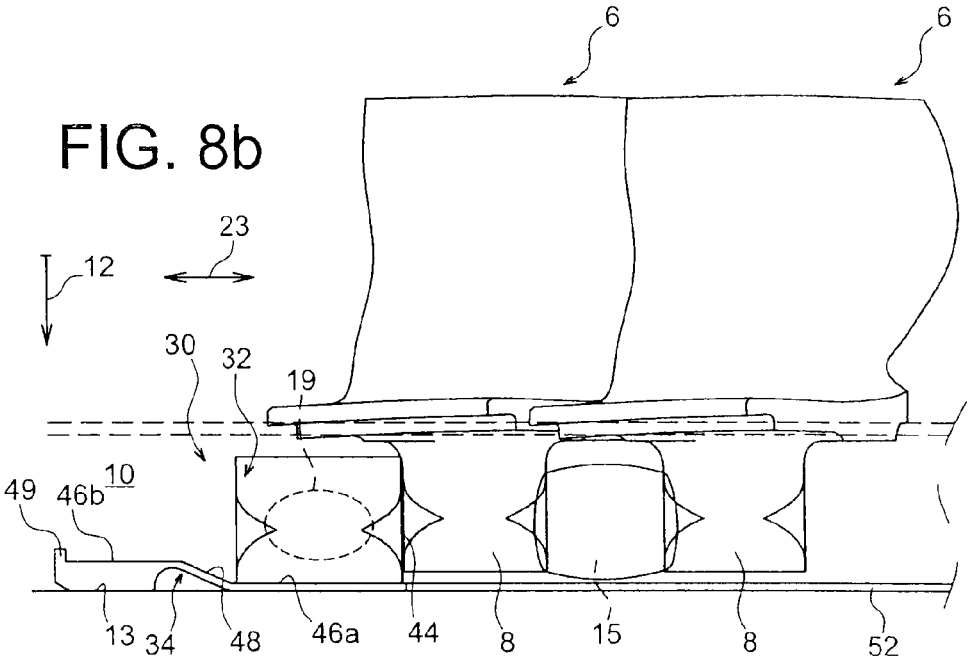
Figure 8C:
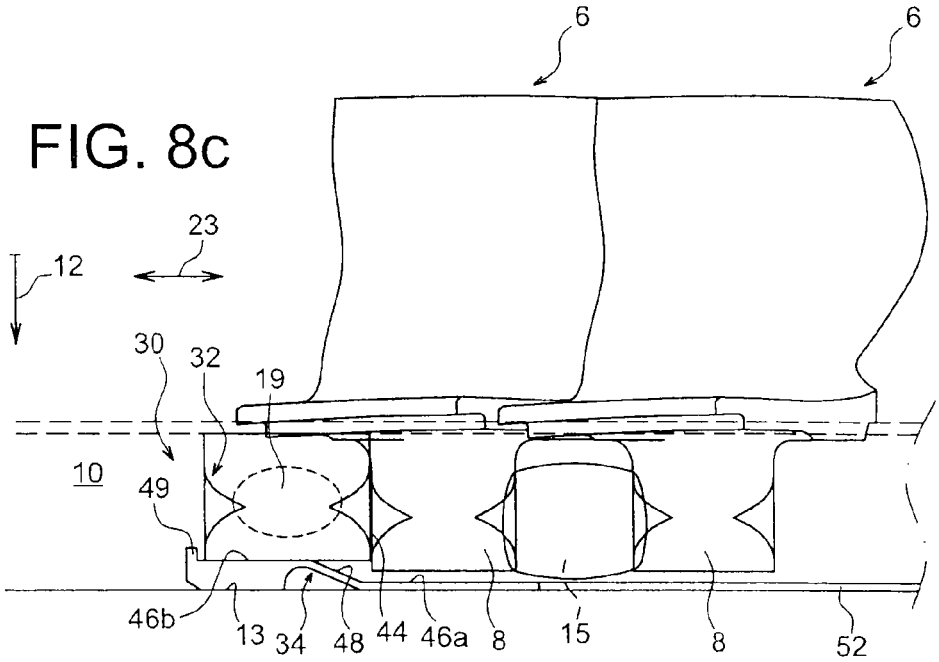

In reference now to FIGS. 8*a* to 8*c*, these show a process for installing the blocking device 30.

First of all, the second piece 34 of the device is introduced in the groove 10, to rest in the base 13 of the latter. This introduction can be done easily, for example by introducing it via the enlarged window 15, then by having it slide circumferentially in the base of the groove to bring it into the preferred position, in which the first support surface 46*a* is located radially opposite the opening 19 as outlined by dotted lines.

If the stop 49 in the form of a picker cannot pass below the vane bases already in place in the groove 10, the base 13 of the latter can be machined to enable such passage.

Next, the first piece 32 is introduced in the groove 10 via the introduction window 15, then slid circumferentially to come to rest on the surface 46*a*, at the base of the ramp 48, as shown in FIG. 8*a*. This retracted configuration, in which the first piece 32 is located radially opposite the opening 19, is maintained by gravity.

Next comes introduction of the remaining vanes 6, conventionally via the introduction window of the vane bases 15. These can be for example of two vanes 6 introduced in the circumferential groove 10 after the device 30 is placed in this same groove. The introduction of the second vane 6 is made possible by circumferential displacement of the device 30 and of the first of the two vanes 6 and of all the elements present in the groove 10 to give free access to the window 15. Next, all the elements present in the groove 10 are chocked circumferentially in the groove 10 to return the first piece 32 radially opposite the opening 19. In this state shown in FIG. 8*b*, the last two vanes introduced 6 are placed on either side of the introduction window 15, preventing them from escaping via the latter. Also, contact between the stop 44 of the first piece 32 and the base 8 of the vane directly adjacent keeps the circumferential position of all the vanes 6 within the groove 10.

Next, a deployment step of the blocking device 30 is undertaken, by circumferential displacement of the second piece 34, operated via the grip tab 52, which is for example accessible to an operator from the window 15, optionally by means of an appropriate tool.

This displacement compels the device 30 to deploy as described in reference to FIGS. 4*a* to 5*b*. It is stopped when the stop 49 arrives in contact with the first piece 32, or slightly before this contact, as outlined in FIG. 8*c*. Regardless, the stop 49 prevents the second piece 34 from being shifted circumferentially by too far, which could let it escape beyond the first piece 32.

Figure 9:
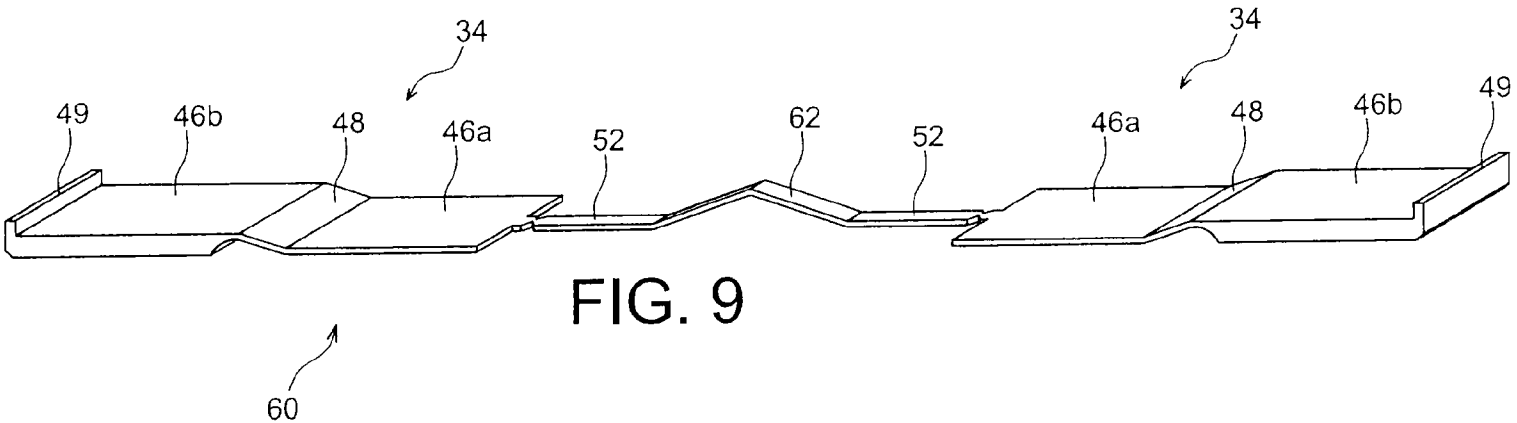
FIG. 9 illustrates a perspective view of a system comprising two pieces intended to respectively enter the constitution of two blocking devices such as that shown in FIG. 6, the system in the form of a preferred embodiment of the invention.

In reference now to FIG. 9, this shows a system 60 comprising two seconds pieces 34 intended to respectively enter the constitution of two blocking devices 30. The two pieces 34, 34 are joined together by the gripping member, here the tab 52 which is therefore common to both devices. In this way, actioning the same tab 52, for example at the level of its central portion in the form of a V 62, it is advantageously possible to cause simultaneous circumferential displacement of both pieces 34, 34 located on either side of the common tab 52. Links 64 forming a mechanical fuse can be made between the ends of the tab 52 and the second pieces 34, 34, for example by providing notches. This controls the breaking points in the event of the system 60 breaking, and adapts the latter to its environment so that the tab 52 can easily be recovered after the latter has been detached accidentally or deliberately from the pieces 34.

Figure 10:
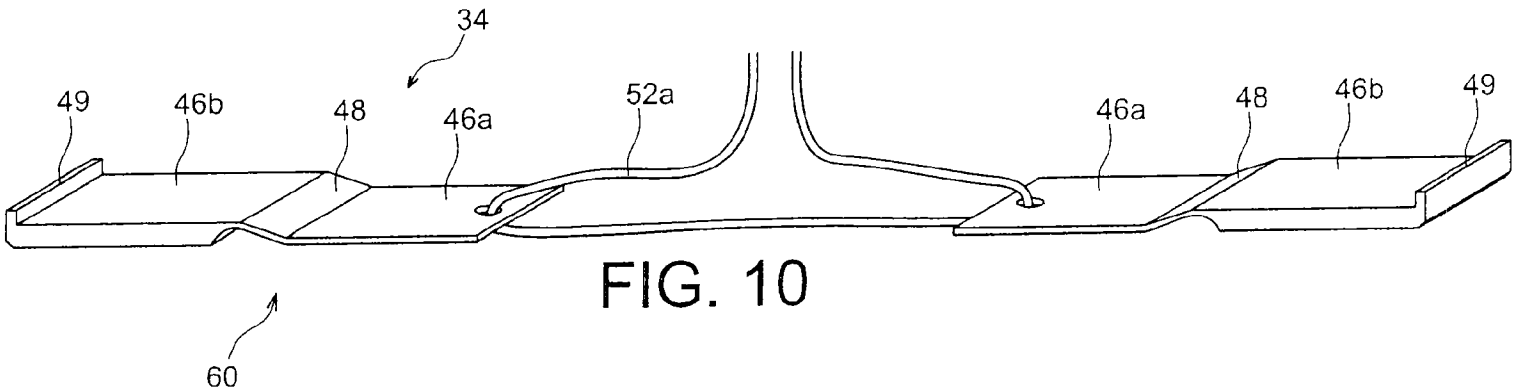
FIG. 10 is a view similar to that of FIG. 9, the system in the form of another preferred embodiment of the invention.

An alternative shown in FIG. 10 is the same cable 52*a* connecting the two pieces 34, 34 of the system 60.

Figure 11A:
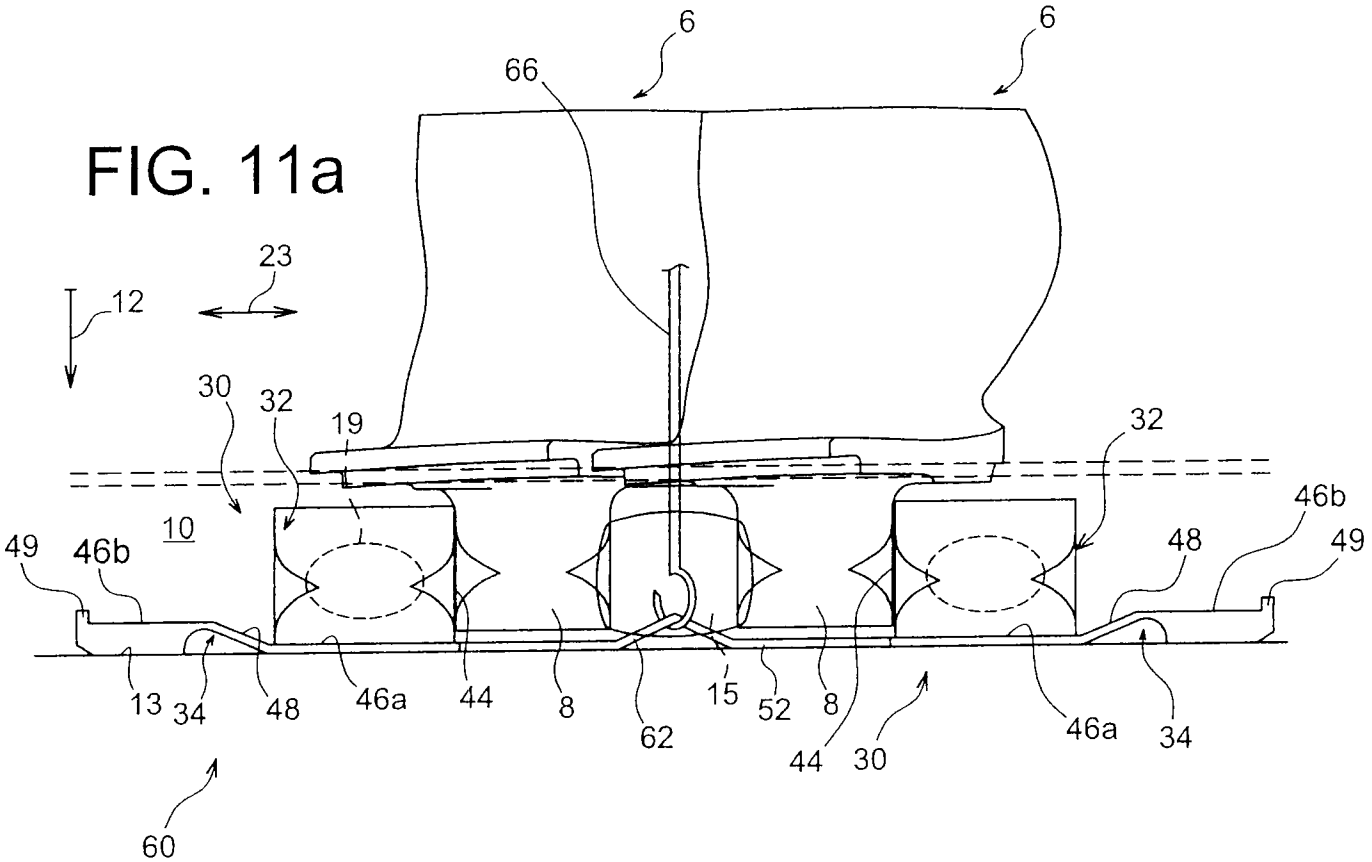
FIGS. 11*a* and 11*b* outline a process according to a preferred embodiment of the invention, for installing two blocking devices integrating the system shown in FIG. 9.
Figure 11B:
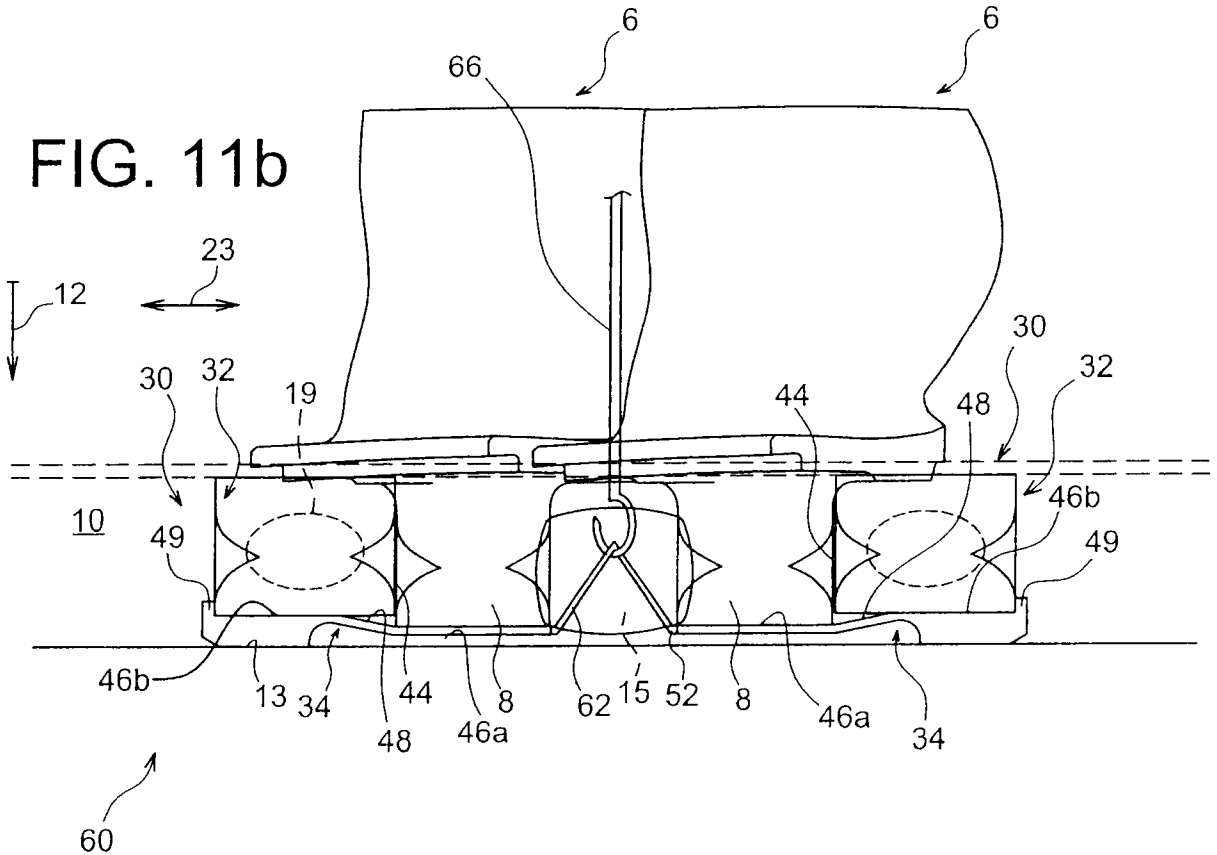

A shown in FIGS. 11*a* and 11*b*, in the event of the system 60 of FIG. 9 being used, it suffices to actuate its central part 62 in the form of a V to guide the two pieces 34, 34 by simultaneous displacement, which tend to come together at the same time as they allow the two relevant blocking devices to reach their deployed configuration. In the case in point, the two last vanes introduced 6, as well as the two vanes adjacent to them (not shown), are blocked circumferentially in both directions, respectively by the two devices 30 sharing the same system 60. Also, it is noted that in the event of breakage of one of the two vanes 6 situated between the two devices 30, only these two vanes 6 can escape via the window 15, as the others cannot reach this window due to the presence of the two devices 30 forming bolts.

Actuation of the V 62 radially to the exterior can be done using a hooked tool 66, cooperating with the base of the V open radially to the interior, this tool being for example inserted in the introduction window 15 passing between the platforms of the two vanes 6, as outlined in FIG. 11*a*.

Once the V is pulled radially to the exterior by the interior of its point, its angle is diminished and its length extended, as shown in FIG. 11*b*. This deformation of the V tends to be conserved by the effect of centrifugal force exerted on the latter, during operation of the turbojet.

The V 62 could naturally be replaced by any other appropriate form, such as a simple plane plate oriented circumferentially, which would then deform progressively to take the form of a V during actuation by the tool 66.

Figure 12A:
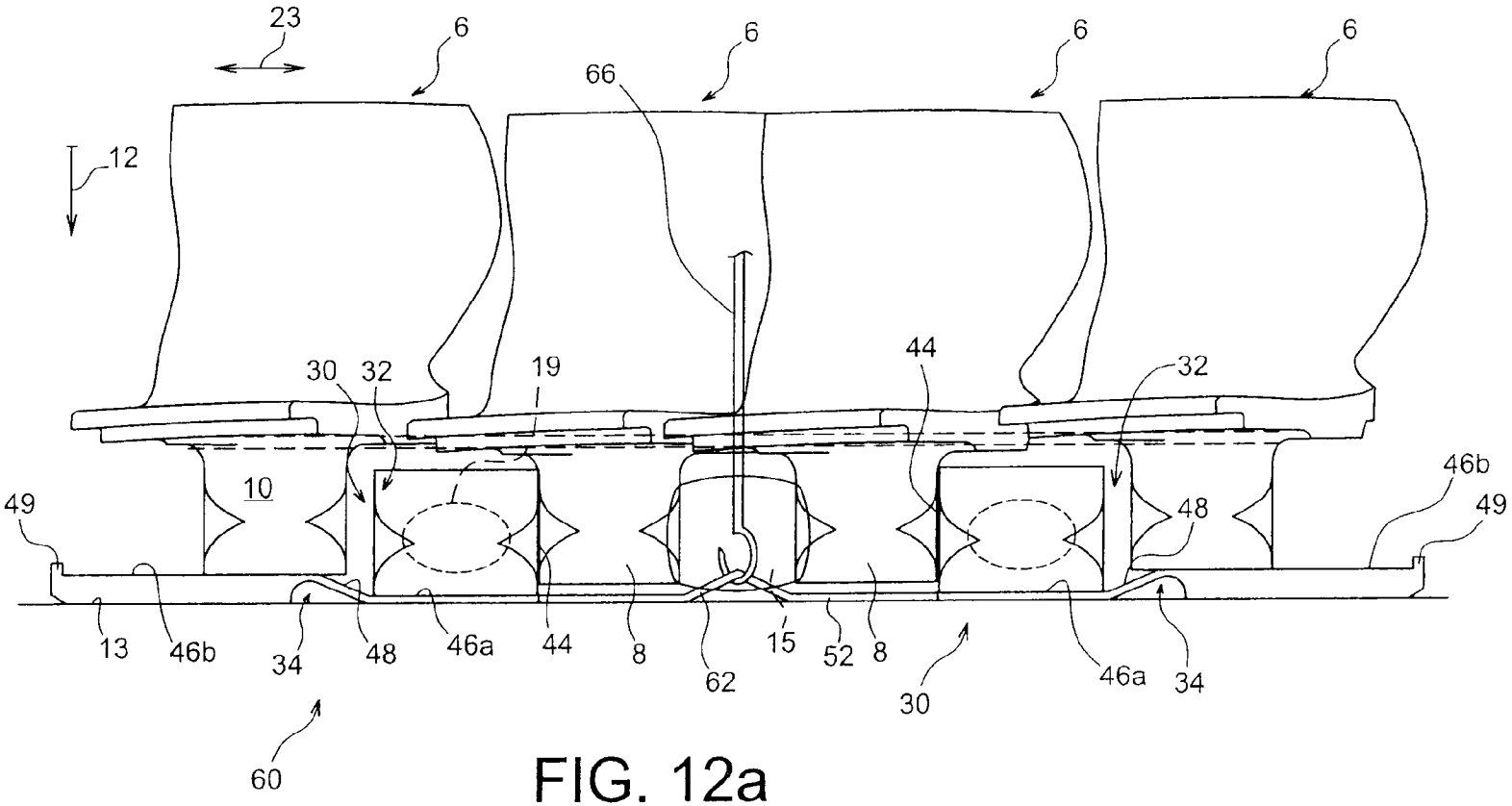
FIGS. 12*a* and 12*b* outline a process similar to that shown on FIGS. 11*a* and 11*b*, in the form of an alternative embodiment.
Figure 12B:
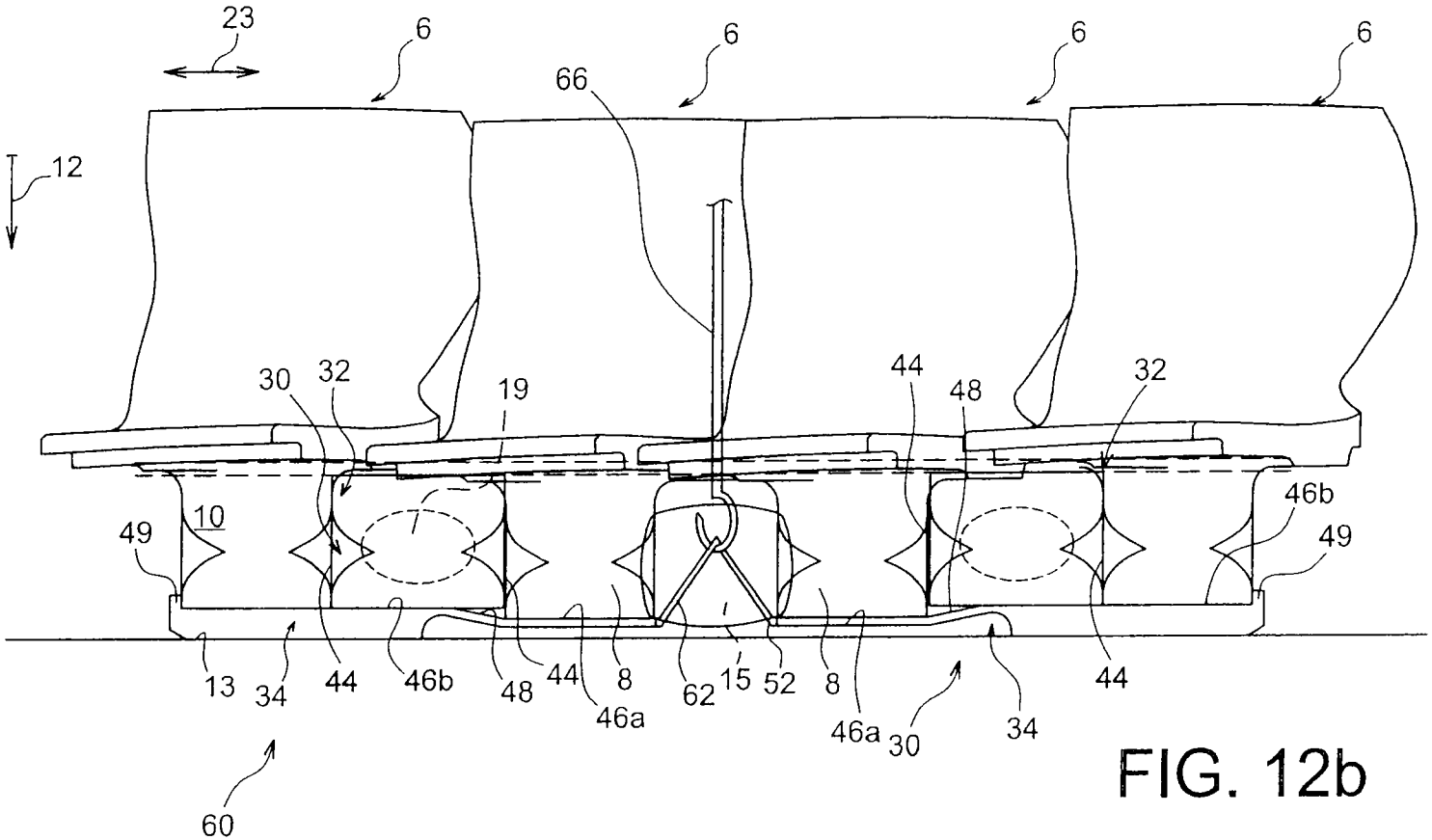

FIGS. 12*a* and 12*b* show that every second piece 34 can also travel under one or more vane bases 6, and that this piece 34, whether or not being integrated with a system 60 such as described hereinabove. In the case in point, the stop 49 is located opposite and possibly in contact with a vane base, and no longer near the first piece 32 of the same blocking device, with which the second piece 34 bearing this stop 49 cooperates.

Figure 13:
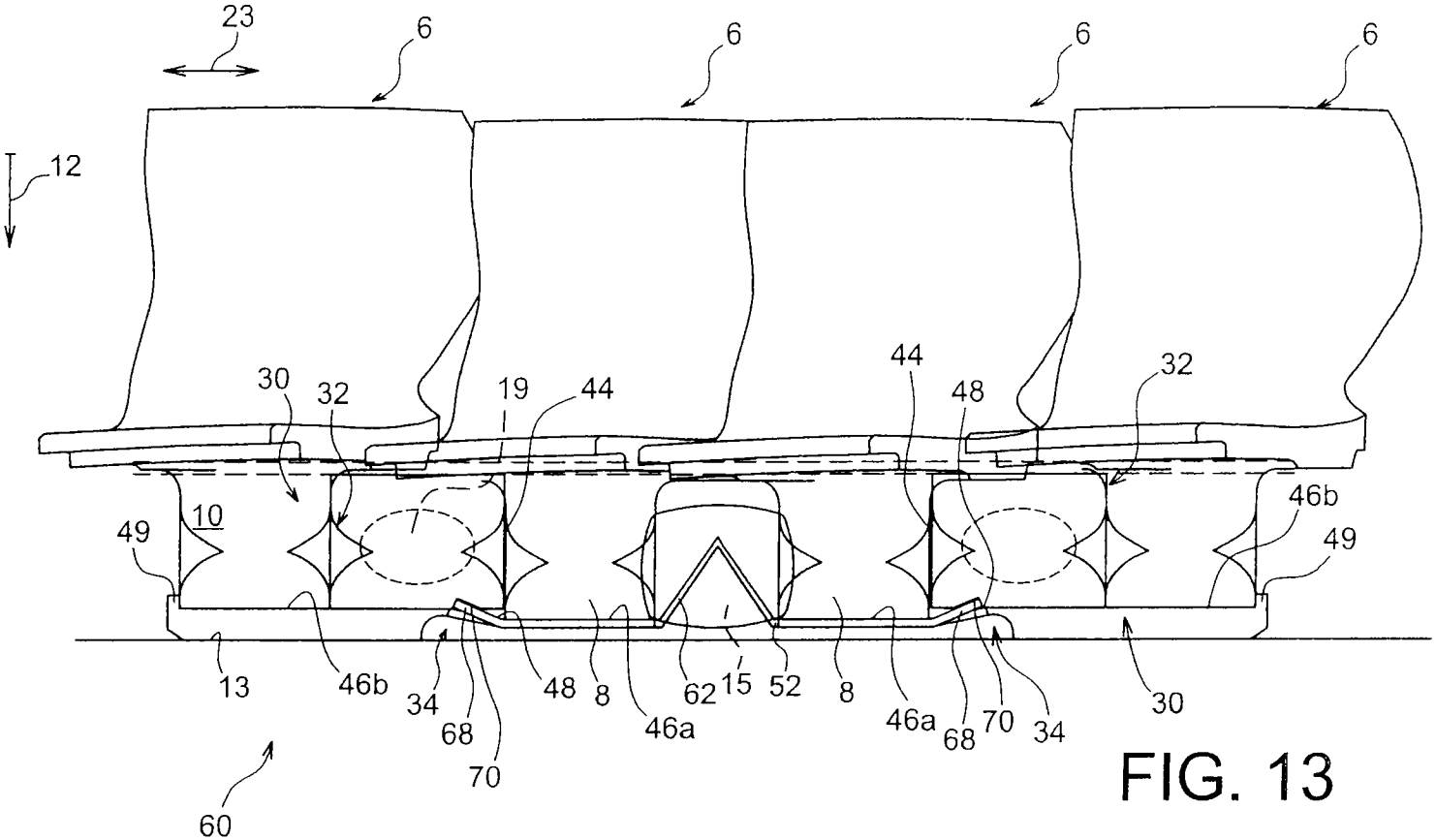
FIG. 13 outlines a process similar to that shown in FIGS. 12*a* and 12*b*, in the form of another alternative embodiment, illustrating by the addition of a positive system for keeping pieces of the blocking device in tangential/circumferential position.
Figure 14:
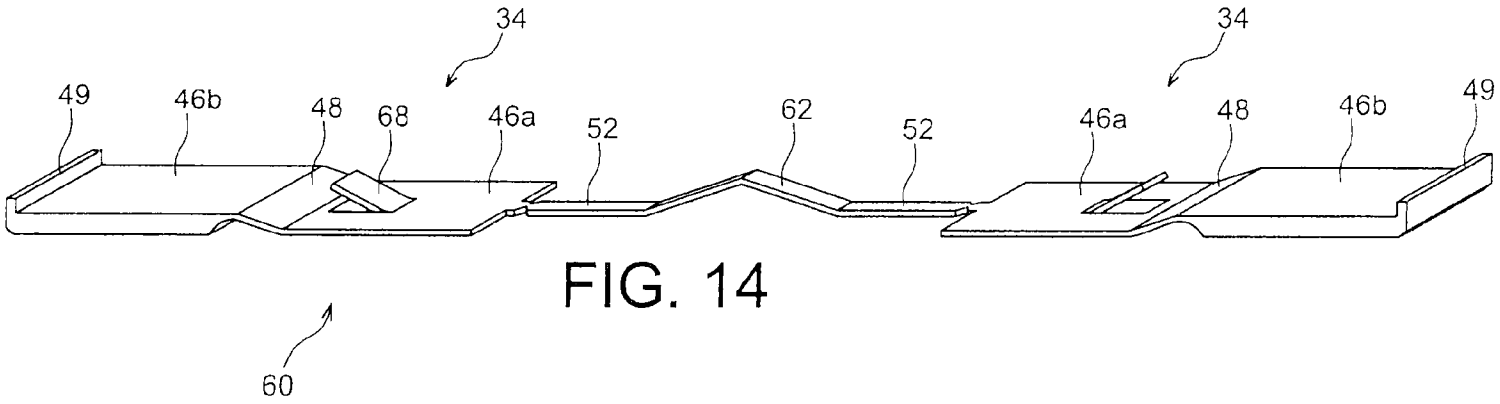
FIG. 14 illustrates a perspective view of the system employed for executing the process outlined in the preceding figure.

FIGS. 13 and 14 show the possibility of providing locking means of each device 30 in a radially deployed position. Specified here is an elastic foot 68 coming from the first surface 46*a*, capable of lodging in a housing 70 of the first piece 32, when the two pieces reach their relative position giving the configuration deployed. The foot 68 and the recess create relative blockage of both pieces in the circumferential direction by way of this cooperation, which can be unlocked only by exerting deliberate action on said foot to create disengagement.

Figure 15:
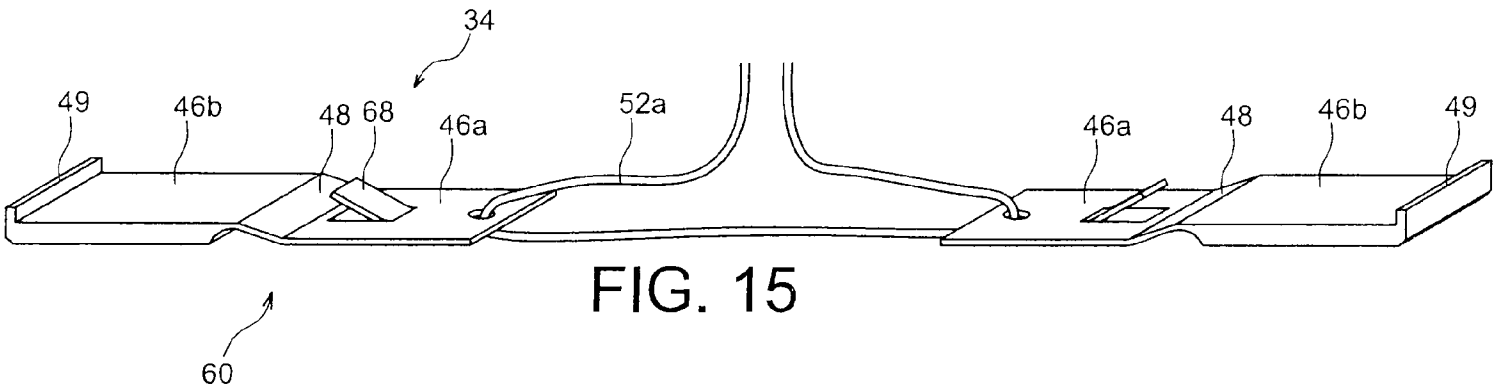
FIG. 15 is a view similar to that of FIG. 14, the system in the form of another preferred embodiment of the invention.

Naturally, these locking means can also be provided when the system comprises the cable 52*a* as a link between the two second pieces 64, as shown in FIG. 15. They are also applicable to the insulated blocking devices 30, of the type described in reference to FIGS. 3 to 8*c*.

Figure 16A:
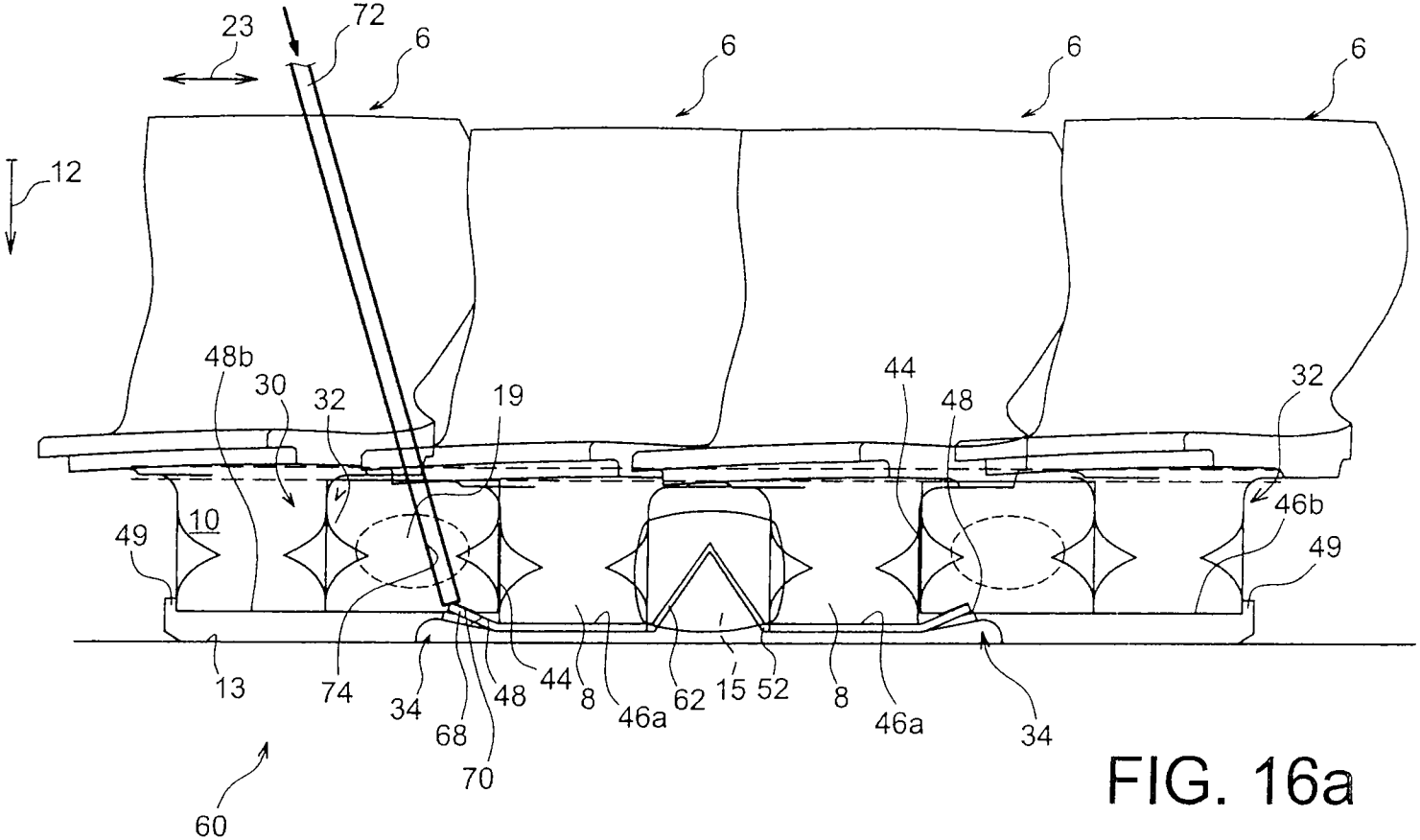
FIGS. 16*a* and 16*b* illustrate views outlining the dismantling of blocking devices, after they are locked by the process shown in FIG. 13.
Figure 16B:
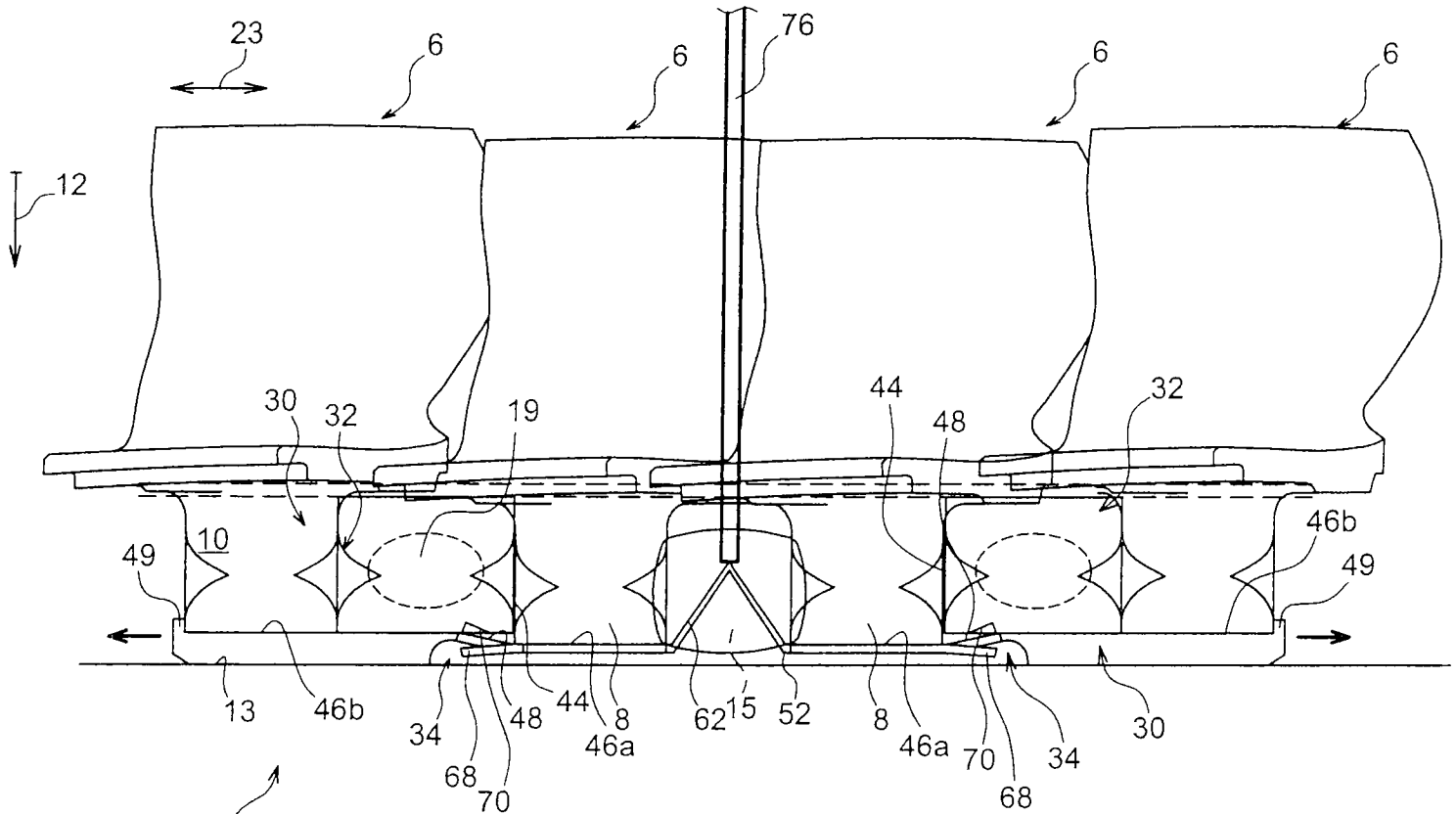

Finally, FIGS. 16*a* and 16*b* show different steps ensuring dismantling of the blocking devices 30. FIG. 16*a* shows that the feet 68 are first disengaged from their recess by a tool 72 inserted in between the vane platforms. Also, for access to each foot 68, the first piece 32 is equipped with an orifice 74 letting the tool head 72 pass, and terminating in the recess 70. This orifice 74 can be made at the time of dismantling, or when the piece 32 is manufactured.

Next, as outlined in FIG. 16*b*, the pieces 34, 34 are shifted circumferentially to unlock the blocking devices 30. This done for example by inserting a tool 76 in between the vane platforms, in the window 15, to lean the tool head against the point of the V 62 of the system 60. This support compels the system 60 to rediscover its configuration such as shown in FIG. 12*a*, with the feet 68 also arranged in a retracted position.

However, any other technique for circumferentially displacing the second pieces 34, 34 can be adopted, without departing from the scope of the invention.

Of course, various modifications can be made by the expert to the invention which has just been described, solely by way of non-limiting examples.

The invention claimed is:

1. A blocking device for vanes in a circumferential groove of a turbine engine disc, said device being designed to deploy in a radial direction to be locked in said circumferential groove open radially, wherein said blocking device comprises a first and second piece designed to deploy in the radial direction by relative displacement of said pieces in the circumferential direction.

2. The device as claimed in claim 1, wherein at least one of said first and second pieces is equipped with a gripping member for being taken along relative to the other piece, according to the circumferential direction.

3. The device as claimed in claim 2, wherein the gripping member is a tab or a cable.

4. The device as claimed in claim 2 or 3, wherein the piece equipped with the gripping member has a stop in the circumferential direction.

5. The device as claimed in claim 1, wherein at least one of said first and second pieces has a ramp for deployment of the device in the radial direction, during relative displacement of said pieces in the circumferential direction.

6. The device as claimed in claim 1, further comprising locking means of for locking the two pieces in a position deployed radially.

7. A system comprising two pieces designed to enter respectively in two blocking devices as claimed in claim 2, wherein said two pieces are joined together by said gripping member on either side of which they are located.

8. The device as claimed in claim 1, wherein said blocking device is configured to pass from a retracted state to a deployed state as said first and second pieces follow said relative displacement in the circumferential direction, wherein a radial dimension of said blocking device increases as said blocking device passes from said retracted state to said deployed state.

9. A turbine engine wheel comprising a disc with a circumferential groove, vanes with bases retained radially by said groove, at least one blocking device designed to deploy in a radial direction to be locked in said circumferential groove open radially, wherein said blocking device comprises a first piece and a second piece designed to deploy in the radial direction by relative displacement of said pieces in the circumferential direction.

10. A turboengine comprising at least one wheel as claimed in claim 9.

11. A process for installing a blocking device in a circumferential groove of a disc of a turbine engine, said blocking device comprising a first piece and a second piece, said method comprising:

placing said blocking device in the circumferential groove; and deploying said blocking device in the radial direction to lock said blocking device in said circumferential groove, by relative displacement of said first and second pieces in the circumferential direction.

* * * * *

UNITED STATES PATENT AND TRADEMARK OFFICE

CERTIFICATE OF CORRECTION

PATENT NO. : 8,858,181 B2
APPLICATION NO. : 13/224774
DATED : October 14, 2014
INVENTOR(S) : Yvon Cloarec It is certified that error appears in the above-identified patent and that said Letters Patent is hereby corrected as shown below:

In the Claims

In column 8, line 24, delete "of".

Signed and Sealed this
First Day of September, 2015

Michelle K. Lee

Michelle K. Lee
*Director of the United States Patent and Trademark Office*